US005279364A

United States Patent [19]

Jantzen et al.

[11] Patent Number: 5,279,364

[45] Date of Patent: Jan. 18, 1994

[54] GUIDE ARCH FOR TUBING

[75] Inventors: Leon K. Jantzen; Ross Pilich; Hans J. Brygger, all of Calgary, Canada; Charles D. Costall, Eagle River, Ak.

[73] Assignee: Canadian Fracmaster Ltd., Canada

[21] Appl. No.: 685,820

[22] Filed: Apr. 15, 1991

[30] Foreign Application Priority Data

Feb. 27, 1991 [CA] Canada ..... 2037240

[51] Int. Cl.[5] ..... E21B 19/08

[52] U.S. Cl. ..... 166/77; 166/85; 226/172; 226/173

[58] Field of Search ..... 166/77, 85, 384, 379; 226/172, 173, 171, 170; 254/389; 242/157 R, 157 C, 86.1

[56] References Cited

U.S. PATENT DOCUMENTS

| | | | |
|---|---|---|---|
| 2,516,383 | 7/1950 | Hays | 226/171 X |
| 2,884,120 | 4/1959 | Bruestle | 226/172 |
| 3,373,818 | 3/1968 | Rike et al. | 166/77 |
| 3,563,436 | 2/1971 | Reynard et al. | 226/173 |
| 3,631,933 | 1/1972 | Bryant | 175/57 |
| 3,841,407 | 10/1974 | Bozeman | 166/77 X |
| 4,417,624 | 11/1983 | Gockel | 166/77 X |
| 4,735,270 | 4/1988 | Fenyvesi | 166/77 X |
| 4,743,175 | 5/1988 | Gilmore | 166/77 X |

FOREIGN PATENT DOCUMENTS

| | | | |
|---|---|---|---|
| 2751564 | 5/1978 | Fed. Rep. of Germany | 175/203 |

OTHER PUBLICATIONS

L. W. Smith, "Methods of Determining the Operational Life of Individual Strings of Coiled Tubing", presented on Nov. 16, 1989 in Arberdeen, Scotland.

*Primary Examiner*—Hoang C. Dang

*Attorney, Agent, or Firm*—Lerner, David, Littenberg, Krumholz & Mentlik

[57] ABSTRACT

There is provided an improved guide arch for guiding the movement of continuous production tubing through a predetermined curvature, the guide arch comprising a housing and an endless curved conveyor mounted within the housing to support the tubing through its curvature, wherein the conveyor continuously supports the tubing along the majority of its length passing through the arch to thereby reduce contact stress between the tubing and the conveyor.

4 Claims, 3 Drawing Sheets

GUIDE ARCH FOR TUBING

FIELD OF THE INVENTION

The present invention relates to a guide and more particularly to a guide arch assembly for directing coiled production or service tubing through a change of direction. Such a change might occur as the tubing travels from a storage reel therefor to a vertical position for injection down a wellbore.

BACKGROUND OF THE INVENTION

In conventional wells for the production of hydrocarbons, one or more cylindrical casings surround a smaller diameter production tubing through which the hydrocarbons will flow to the wellhead. Production tubing conventionally consists of discrete lengths of steel tubing threaded together end-to-end to form a production string extending downhole from the wellhead to the zone or zones of hydrocarbon concentrations. The insertion and periodic removal of the production tubing for well servicing purposes was and is a time consuming and therefore expensive process due to the time and equipment needed to make or break the connections in the string and to store the discrete lengths of tubing when not in use.

Similarly, several types of well workovers, such as cleanouts, require that the production tubing be removed and replaced with service tubing. The same problems mentioned above in relation to production tubing are encountered if the service tubing similarly consists of discrete lengths of metal pipe threaded together end to end.

More recently, continuous tubing has been developed that is capable of storage on a reel much like rope and that has facilitated a much speedier and more economical means of injecting or removing the tubing using specialized service rigs. Typically enough tubing can be stored on a single reel to eliminate the need for any pipe connections and this greatly speeds the injection and withdrawal steps.

In the downhole coiled tubing service industry, the conventional method of guiding the tubing from the roughly horizontal or upwardly sloping direction of the tubing coming off the spool to the vertical direction required for downhole injection is accomplished using a roller-type tubing guide arch. Such arches typically include a plurality of spaced apart rollers placed at discrete intervals around the curvature of the arch for supporting the tubing passing thereover. The spacing of these rollers and their small diameter in relation to the bend radius of the tubing contributes significantly to stress and fatigue in the tubing by forcing it to bend more sharply as it passes over each roller. The tension in the tubing string due to its own weight and resistance to being uncoiled pulls the tubing forcefully against each roller thereby inducing excessively high contact stresses in the tubing due to the very small roller surface area in contact with the tubing passing thereover. This then leads to shortened tubing life and more frequent failure in the string due to a concentration of bending moments and the problems caused thereby.

SUMMARY OF THE INVENTION

It is therefore an object of the present invention to provide an improved guide arch which obviates and mitigates from the disadvantages of the prior art.

According to the present invention then, there is provided a guide arch for guiding the movement of tubing through a predetermined curvature, said guide arch comprising housing means, endless curved conveyor means mounted within said housing means to support said tubing through the curvature thereof, wherein said conveyor means continuously support said tubing along the majority of the length thereof passing over said arch for reducing contact stress between said tubing and said conveyor means.

In a preferred embodiment of the present invention, the applicant's arch uses a form of conveyor for continuously supporting the tubing over a curvature of constant radius to eliminate or at least greatly reduce the high stresses otherwise localized at the points where the tubing is forced to change direction sharply as it passes over each roller in a conventional guide arch. In addition to the smooth, continuous curvature of the present arch, applicant's conveyor guide provides in a preferred embodiment a large surface area in constant contact with the tubing passing thereover to reduce surface contact stresses to insignificant levels, thereby leading to increased tubing life and lower failure rates. In a further preferred embodiment, this large contact area is provided by means of support blocks having semi-circular recesses therein to conformably receive an associated length of the tubing therein.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
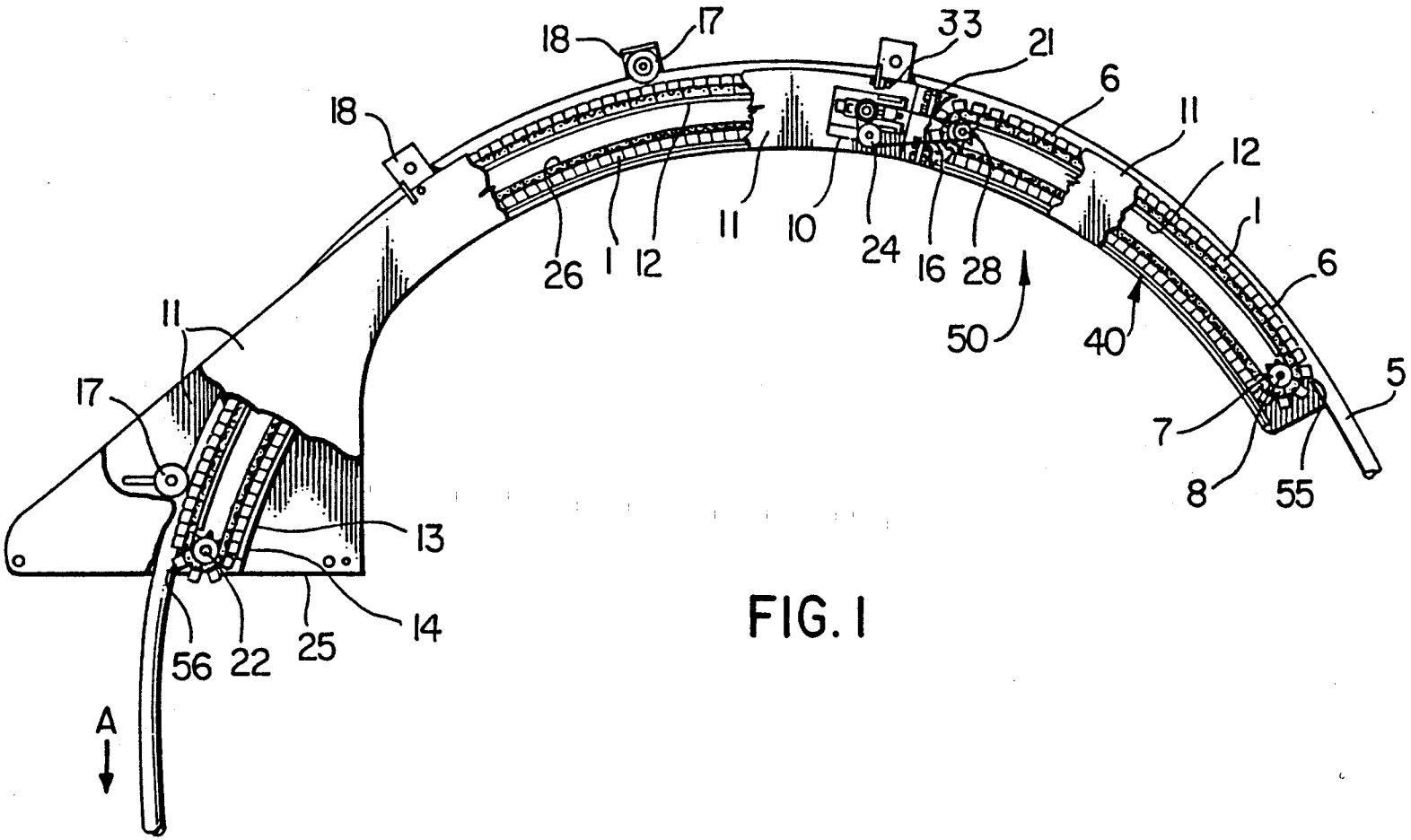
FIG. 1 is a side elevational, partially cut-away view of the present conveyor guide.

With reference to FIG. 1, the present conveyor guide arch 50 (conveyor guide) comprises a curved housing 40 defined on its side by a pair of opposed side plates 11 and conveyor chains 6 and 26 for supporting and guiding continuous tubing 5 from a spool or reel thereof (not shown) through a predetermined curvature which may exceed 90° into a vertical position for injection down a wellbore (not shown) in the direction of arrow A. It will be understood that the present guide can be used equally effectively in the opposite direction when tubing is to be removed from a well. The rate of curvature of conveyor chains 6 and 26 is constant from the point 55 where tubing 5 first makes contact with conveyor 6 to point 56 where the tubing is discharged to avoid causing localized stress in the tubing due to sudden changes in its direction of travel.

Conveyor 6, which will be described in greater detail below, is supported at opposite ends on sprockets 7. The sprockets are mounted on rotatable shafts 8 journalled into bearings (such as ball bearings) (not shown) mounted onto opposed outer surfaces of side plates 11. Between sprockets 7, the curvature of conveyor chain 6 is defined along its upper tube-supporting run by a roller track 12 suspended between opposed inner surfaces of side plates 11, and on the return loop by a low-friction slide 14 and, if needed, a backup plate 13, both of which are similarly suspended from opposite inner surfaces of the side plates.

Conveyor chain 26, which is structurally identical to chain 6, is similarly supported at its opposite ends on sprockets 22 and 23 with the desired curvature being imparted on the upper run by roller track 12 and on the return loop by a slide 14 and backup plate 13.

Figure 2:
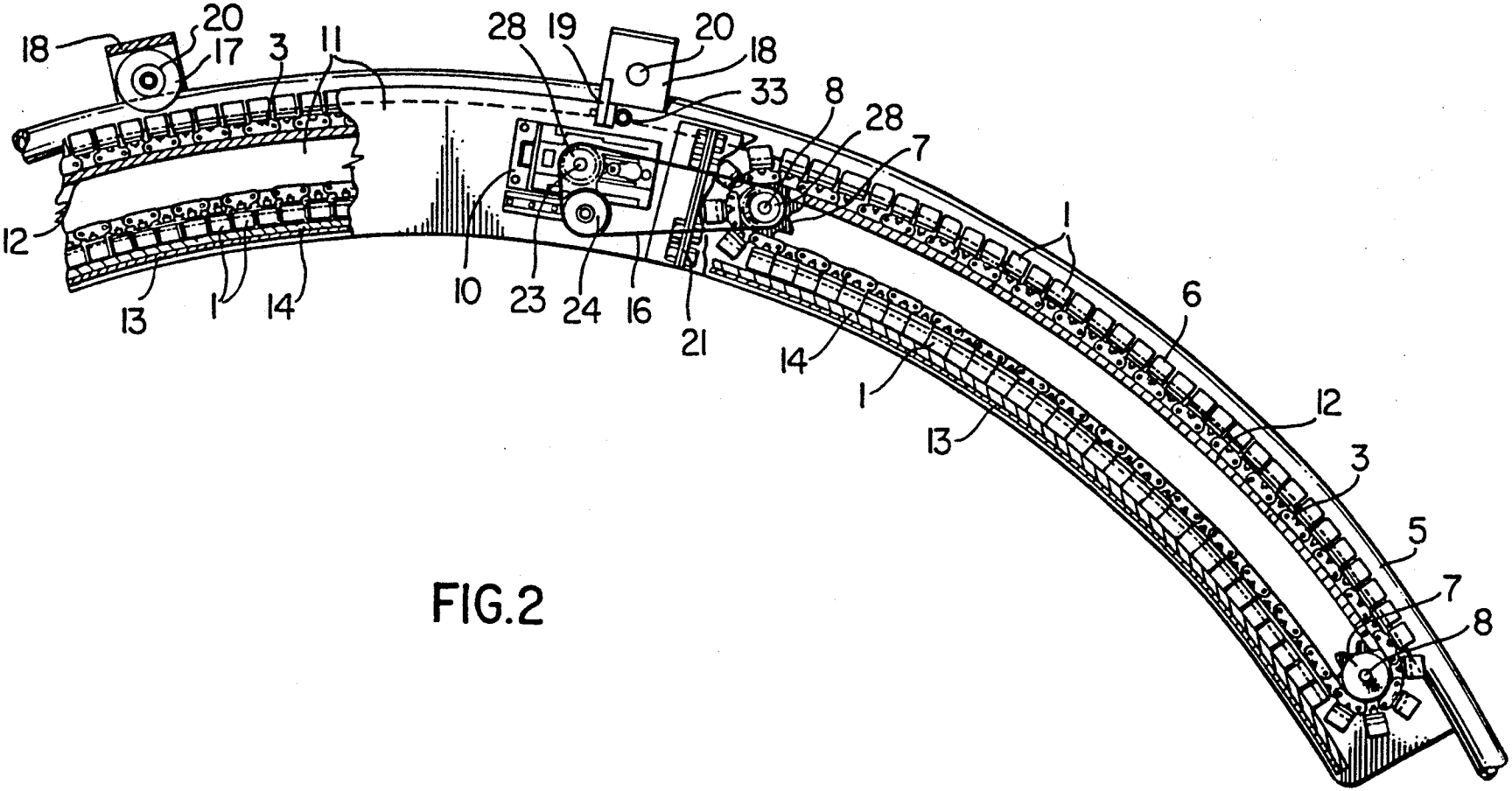
FIG. 2 is a side elevational, partially sectional view of a portion of the conveyor guide of FIG. 1.

The present guide may consist of a single conveyor chain, but depending upon the guide's length and total curvature, it will more typically consist of, as shown in the appended drawings, two or more conveyor chains separately housed within individual sections bolted together as at 21 (FIG. 2). Where the guide consists of or includes more than one conveyor chain, it may be desirable, although not necessary, that the individual chains be linked to one another to ensure their rotation at the same speed. Such a connection ensures moreover that the tubing doesn't merely slide over upstream conveyor chain 6. In this regard, tubing 5 will uniformly engage the entire length of downstream conveyor chain 26 to cause its rotation at the same speed as the tubing's own rate of travel. On the other hand, tubing 5 may not necessarily engage the entire length of chain 6, particularly if the tubing comes in at a smaller angle to the horizontal in which case its contact with chain's will be more glancing in the area approaching the chain's downstream end. Connection between the two chains ensures therefore that chain 6 will always rotate at the same speed as the tubing to avoid an abrasive sliding contact between these two elements.

With reference to FIG. 2, there is shown a means for connecting the two conveyor chains to ensure their uniform rate of rotation. Sprocket 23 supporting the upstream end of conveyor chain 26 is mounted into a bearing take-up frame 10 that is itself adjustable to allow for adjustments to this chain's tension. Frame 10 is supported on the opposed outer surfaces of side plates 11. Sprocket 23 and sprocket 7 at the downstream end of conveyor 6, which are of equal size, each include a side sprocket also of equal size shown schematically at 28 to engage timing chain 16. An adjustable idler sprocket 24 is provided to maintain proper tension in timing chain 16 particularly in response to any adjustments to the position of sprocket 23. As will be obvious, as chain 26 rotates, so will chain 6 due to the interconnection provided by chain 16.

Figure 4:
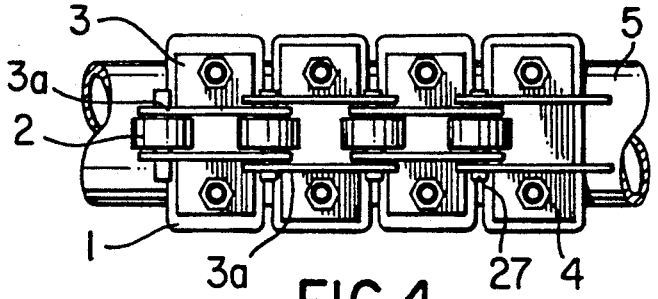
FIG. 4 is a bottom elevational view of the conveyor chain of FIG. 3.
Figure 5:
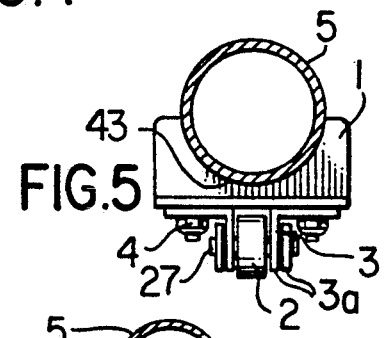
FIG. 5 is an end elevational, partially sectional view of the conveyor chain of FIG. 3.

Chain conveyors 6 and 26 will now be described in greater detail with reference to FIGS. 3, 4 and 5. The two conveyors are essentially identical so that the following description applies equally to both.

Figure 3:
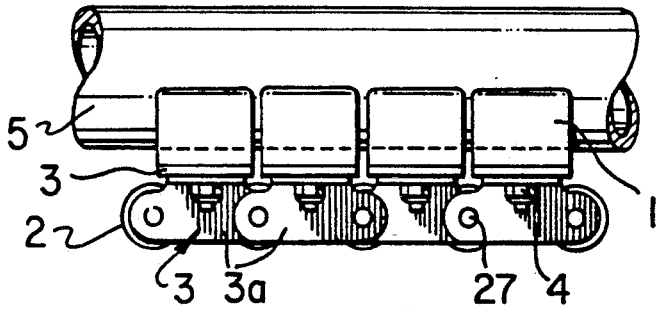
FIG. 3 is a side elevational view of part of a conveyor chain forming part of the assembly of FIG. 1.

With reference to FIG. 3, a length of tubing 5 is shown supported on a length of conveyor chain 6 comprising a plurality of closely spaced links which together form an endless loop. Each link includes a support block 1 which supports the overlying associated length of tubing 5 as it passes through the arch. Each support block 1 is aligned orthogonally to the direction of travel of the tubing and is fastened to a pair of inverted L-shaped flange-like attachment plates 3 with holes formed therein to receive studs and nuts 4 for connecting the support block and attachment plates together. The vertical legs **3*a* of the attachment plates are connected together by means of pins 27 which additionally rotatably support carrier rollers 2. As shown most clearly in FIG. 4, the distance between opposed pairs of vertical legs 3*a*** is staggered to permit the necessary interlinking to form the conveyor chain.

Each support block 1 is formed with a semi-circular concavity 43 to conformably receive therein the associated length of tubing 5. This provides the highest possible surface contact between the tubing and the conveyor chain to minimize contact stress with the tubing.

Figure 6:
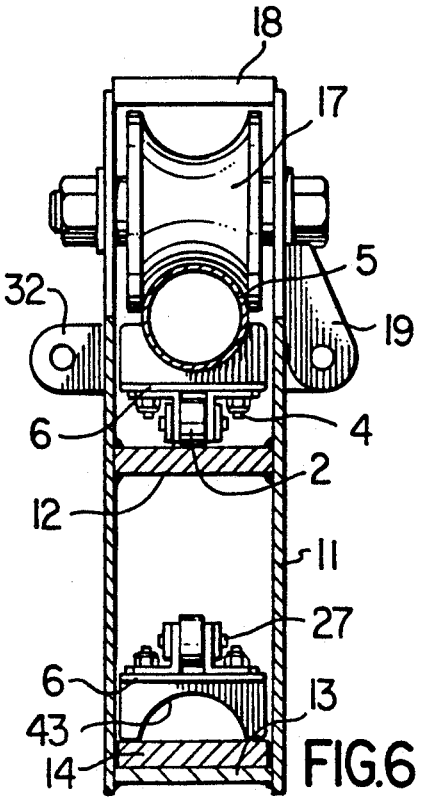
FIG. 6 is a cross-sectional view of the conveyor guide of FIG. 1 along the line A—A.
Figure 7:
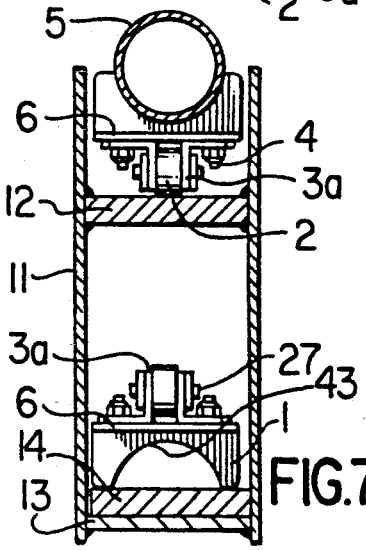
FIG. 7 is a cross-sectional view of the conveyor guide of FIG. 1 along the line B—B.

With reference to FIGS. 6 and 7, conveyor chain 6 in operation runs between side plates 11 on carrier rollers 2 which engage curved roller track 12. On the return loop, chain 6 is supported by curved low-friction slide 14 consisting of, for example, a suitable wear-resistant polymer material. Added strength, if needed, is provided by a metallic backup plate 13.

Conveyors 6 and 26 run without any external power being applied thereto and will rotate without slippage relative to tubing 5 so long as the frictional contact between the tubing and support blocks 1 exceeds the rolling friction in the conveyors themselves.

The present guide additionally includes a number of spaced apart grooved rollers 17 located above tubing 5 to keep the tubing and supporting segments of conveyor chains 6 and 26 centered between plates 11 and to prevent the tubing from jumping the guide. Each roller 17 is rotatably supported on a bearing 20 and is mounted in a frame 18 pivotally connected to one of side plates 11 by means of a hinge 19 to allow for the installation of the tubing. Each frame 18 additionally includes a suitable means 32 allowing it to be locked down to the opposite side plate 11 such as by means of a pin 33 as seen most clearly in FIG. 2. Other lock-down means will of course readily occur to those skilled in the art.

The present guide will typically be mounted onto the frame of a known coiled tubing injector (not shown), and to facilitate this connection, side plates 11 may be widened at one end as shown at 25 to allow for fasteners used in making the connection to the injector. The usual form of connection is by pinning to simplify installation and disassembly.

In operation, tubing 5 normally makes tangential contact with the conveyor chain and remains in contact with the chain while bending through the desired angle before being discharged from the guide tangentially to the downstream end of the conveyor chain. The guide functions the same whether the tubing is being injected into or removed from the wellbore. Bending of the tubing itself over the guide is substantially due to its own resistance in being unspooled.

It is contemplated that in some applications, an external drive may be applied to the conveyor chains to cause their rotation.

We claim:

1. A guide arch for guiding the movement of a length of tubing having an outside radius through a predetermined curvature, said guide arch comprising:

a housing; and endless conveyor means arranged along a curve having a constant radius of curvature for supporting a section of said tubing for movement relative to said housing, said conveyor means including an endless chain having a plurality of pivotally-connected links, each link having mounted thereon at least one block so that said blocks are immediately adjacent one another to present a substantially continuous convex surface along said curve for supporting said section of said tubing, each said block being formed with a concave recess which is semi-circular in cross-sectional shape with a radius which equals said outside radius of said tubing so that said tubing fits conformably within said recesses, wherein said conveyor means substantially continuously supports said section of tubing to thereby reduce contact stress between said section of tubing and said conveyor means.

2. The guide arch of claim 1, wherein said conveyor means comprise at least two of said endless chains arranged sequentially along said curve, and connecting means for connecting said at least two chains so that said at least two chains move together relative to said housing.

3. A guide arch for guiding the movement of a length of tubing through a predetermined curvature, said guide arch comprising:

a housing; and endless conveyor means arranged along a curve having a radius of curvature for supporting a section of said tubing for movement relative to said housing, said conveyor means including an endless chain having a plurality of pivotally-connected links, each link having mounted thereon at least one block so that said blocks are immediate adjacent one another to present a substantially continuous convex surface along said curve for supporting said section of tubing, each said block being formed with a concave recess for receiving said tubing supported thereon, wherein said conveyor means substantially continuously supports said section of tubing to thereby reduce contact stress between said section of tubing and said conveyor means.

4. The guide arch as claimed in claim 3, wherein said concave recesses in said plurality of blocks define a total surface area which is approximately equal to an area of continuous surface of said section of said tubing confronting said concave recesses.

* * * * *